US006736160B2

(12) United States Patent
Nagai et al.

(10) Patent No.: US 6,736,160 B2
(45) Date of Patent: May 18, 2004

(54) VALVE STRUCTURE FOR ENGINE EXHAUST SYSTEM

(75) Inventors: Tadashi Nagai, Tokyo (JP); Eiichiro Hashimoto, Tokyo (JP); Masaomi Fukuhara, Tokyo (JP); Kai Shiraishi, Tokyo (JP); Tamio Oshima, Tokyo (JP)

(73) Assignee: Calsonic Kansei Corporation, Tokyo (JP)

( * ) Notice: Subject to any disclaimer, the term of this patent is extended or adjusted under 35 U.S.C. 154(b) by 281 days.

(21) Appl. No.: 10/067,216

(22) Filed: Feb. 7, 2002

(65) Prior Publication Data

US 2002/0104503 A1 Aug. 8, 2002

(30) Foreign Application Priority Data

Feb. 7, 2001 (JP) ..... 2001-030891
Mar. 30, 2001 (JP) ..... 2001-099113

(51) Int. Cl.[7] ..... F02N 3/00
(52) U.S. Cl. ..... 137/527.6; 137/527
(58) Field of Search ..... 137/527, 527.8, 137/527.6

(56) References Cited

U.S. PATENT DOCUMENTS 3,703,937 A 11/1972 Tenney
3,883,111 A * 5/1975 Jourdan ..... 137/527
4,850,059 A * 7/1989 Dickerson ..... 137/527.8
5,327,933 A * 7/1994 Ishikawa et al. ..... 137/527.6
5,747,753 A 5/1998 Eder
5,801,343 A 9/1998 Suzuki et al.

FOREIGN PATENT DOCUMENTS

JP 9-250326 9/1997
JP 9-250330 9/1997
JP 10-131738 5/1998

* cited by examiner

*Primary Examiner*—Kevin Lee
(74) *Attorney, Agent, or Firm*—Foley & Lardner LLP

(57) ABSTRACT

A support member 10 having a tubular portion 11 is joined at an end portion of a muffler pipe 1. The support member 10 forms a flange 12 as a valve seat and a support bracket 14. The support bracket 14 has a valve disk 20 supported rotatably via a hinge axis 15. The valve disk 20 has an outer peripheral portion 12 as a contact surface with the valve seat, and a weight 30 is welded to a bead portion 23 with an inner portion thereof projecting to the back face. A spring is wound around the hinge axis, with one end 18 engaging a back face of the valve wall 21 for the valve disk, the other end engaging a support bracket. The resonance frequency is decreased by the weight, thereby preventing the beat sound from arising in a normal range of the engine speed. The weight is welded to the bead portion, thereby not causing the outer peripheral portion 23 as the contact surface to be distorted.

10 Claims, 10 Drawing Sheets

VALVE STRUCTURE FOR ENGINE EXHAUST SYSTEM

BACKGROUND OF THE INVENTION

1. Field of the Invention

The present invention relates to a valve structure installed in an engine exhaust system.

2. Description of the Related Art

Conventionally, as a valve of this kind, a structure is known in which a valve is installed in a pipe passage within a muffler of the vehicle.

This structure improves the silencer effect by opening or closing an exhaust passage corresponding to a variation in pressure of an exhaust gas flowing in from the engine side, and prevents a decrease in the engine output. In such an exhaust pressure sensitive valve, a spring is annexed for biasing a valve disk in a closing direction, and the valve is opened when an exhaust pressure enough to overcome a biasing force of the spring is exerted.

By the way, in an environment where high pressure exhaust gases flow, a hinge portion for carrying the valve disk can not be fitted minutely in view of an expansion or shrinkage due to thermal expansion, the precision of the rotation axis being relatively rough. Hence, if a contact surface between the valve disk and a valve seat is inclined conically, for example, the center between them is dislocated even in a state where the valve is closed, developing a gap in practice.

Accordingly, the contact surface between the valve disk and the valve seat is made planar, as shown in FIG. 10.

In the valve structure as shown in the figure, a support member 10 extending from a muffler pipe 1 has a flange 12 and forms the valve seat. The valve disk 40 carried around a hinge axis 15 by a support bracket 14 of the support member 10 has an entire smooth face that is opposed to the flange 12 of the support member, with a flange 41 around its peripheral edge. A spring 16 is wound around the hinge axis 15, and biases the valve disk 40 toward the flange 12 that is the valve seat.

The valve disk 40 is opened when the exhaust pressure is increased, or closed when the exhaust pressure is decreased. In the case where the valve disk is made from a thin sheet by press molding, the resonance frequency is higher due to a combined effect between the valve disk and the spring 16 annexed, so that the valve disk 40 is caused to vibrate at an engine speed of 2000 to 3000 rpm in a normal range of the engine, leading to a problem that beats are produced and the quality sense of the vehicle is deteriorated.

To suppress the vibration of the valve disk, it is conceived to increase a biasing force of the spring 16 for biasing the valve disk 40 in the closing direction. However, if the spring force is increased, the valve may not be opened till the exhaust pressure becomes a considerably high value, so that the proper object can not be attained.

On the other hand, if the spring force is reduced to make the resonance frequency lower, the opening valve pressure for opening the valve is decreased, so that the valve is frequently opened or closed due to slight variations in exhaust pressure because the valve disk 40 itself is light in weight.

SUMMARY OF THE INVENTION

Accordingly, the invention has been achieved in the light of the above-mentioned problems associated with the conventional art, and it is an object of the invention to provide a valve structure for an engine exhaust system in which vibration of a valve disk due to resonance is suppressed in the case where the valve disk is made from a thin sheet and light in weight.

According to the invention, there is provided a valve structure for an engine exhaust system in which a valve installed in an exhaust passage is opened or closed in accordance with an exhaust pressure, with a valve disk biased in a closing direction by a spring being supported around a rotation axis, wherein the valve disk is formed with a bead portion in a region excluding a contact surface of a valve wall with a valve seat, and a weight is fixed to the bead portion.

Since the weight is fixed to the valve wall, the resonance frequency of the valve disk can be changed while the predetermined characteristics of the spring are retained.

The valve wall of the valve disk has an outer peripheral portion shaped like a ring as the contact surface, the bead portion has an inner diameter portion projecting out to the back side from the outer peripheral portion, and the weight is fixed to the bead portion on a back face of the valve wall. Since the weight is fixed to the back face of the valve wall, there is no risk of interference with the valve seat.

The spring is wound around the rotation axis, with one end engaging the back face of the valve wall, and the weight is fixed except for an engagement point at one end of the spring. Since the engagement point of the spring is avoided, there is no risk that one end of the spring is engaged on the weight accidentally.

According to the invention, there is provided a valve structure for an engine exhaust system in which a valve installed in an exhaust passage is opened or closed in accordance with an exhaust pressure, a valve disk biased in a closing direction by a spring is supported around a rotation axis, wherein the valve disk has a weight of circular arc fixed on a back face along an outer peripheral edge including an arcuate portion most left away from the rotation axis of a valve wall.

Since the weight is fixed to the valve wall, the resonance frequency of the valve disk can be changed while the spring is kept at the predetermined characteristics. Particularly, since the weight is fixed along the arcuate portion around the outer periphery edge of the valve disk, the maximum moment can be obtained for the rotation axis.

A flange is formed around the outer periphery of the valve wall, and the weight is disposed along the inside of the flange, and welded to the flange. Thereby, the weight can be positioned by abutting it against the flange.

The flange is further provided with a projection piece, and the weight is welded at the tip of the projection piece. Since the welded part is separated away from the contact surface of the valve wall, the welding heat is not passed to the contact surface.

A flange with a holding piece is formed around the outer periphery of the valve wall, and a convex portion projecting to the back side is formed inside a contact surface of the valve wall with a valve seat, whereby the weight is disposed between the flange and the convex portion along the inside of the flange, and pressed and fixed to the valve wall by caulking of the holding piece. Since the weight is fixed by caulking of the holding piece, the effect of welding heat does not arise at all.

The weight is formed by cutting a strip steel plate. The weight can be produced with excellent yield by cutting the strip steep plate along the arcuate portion around the outer peripheral edge of the valve disk.

The weight is formed by bending a steel material of a predetermined cross section. The weight can be produced with excellent yield only by cutting and bending the steel material.

DETAILED DESCRIPTION OF THE PRESENT INVENTION

The present invention will be described with reference to the accompanying drawings.

First Embodiment

A first embodiment of the present invention will be described below.

Figure 1A:
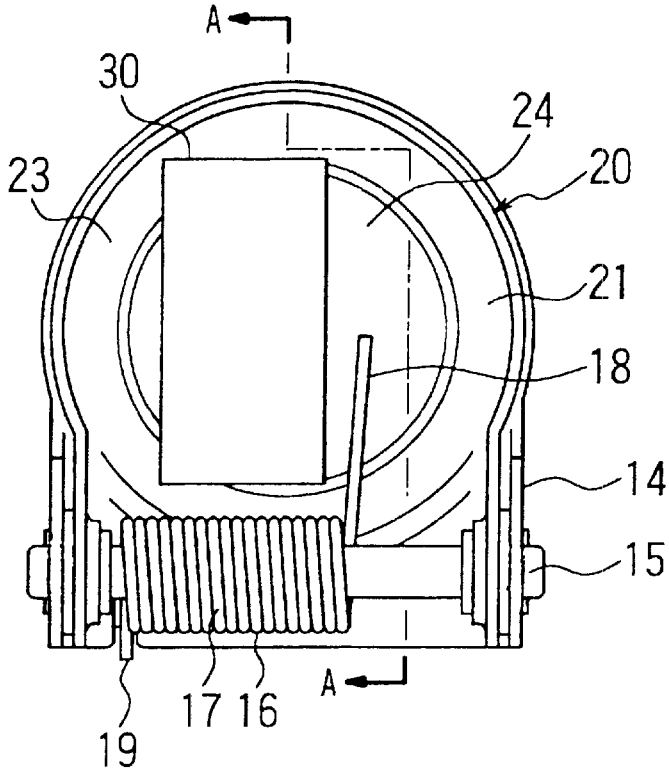
FIGS. 1A and 1B are views showing a first embodiment of the present invention.
Figure 1B:
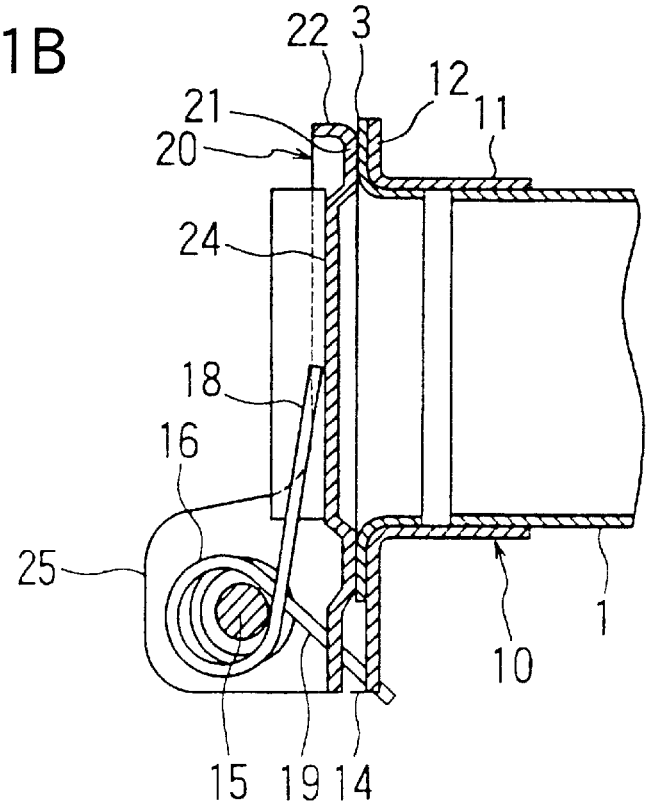
Figure 2A:
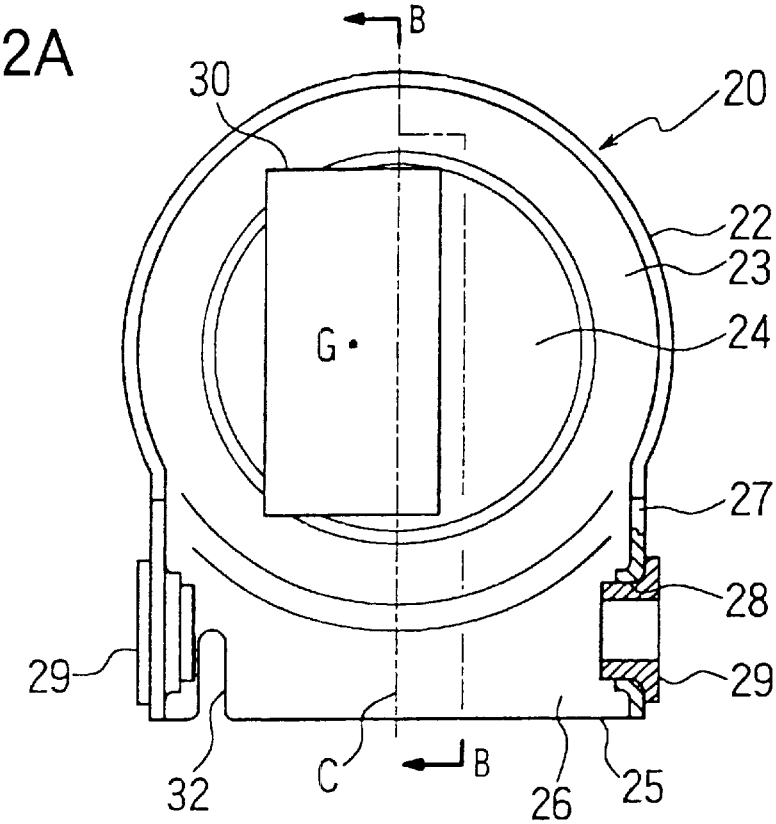
FIGS. 2A and 2B are enlarged views of a valve disk.
Figure 2B:
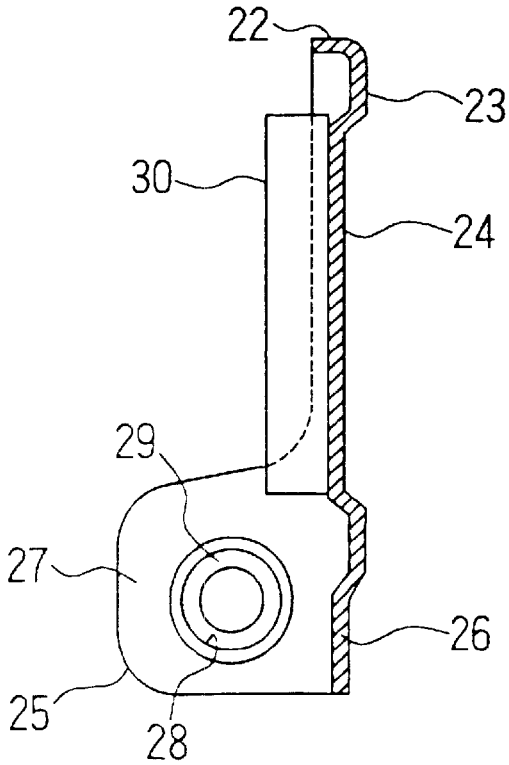

Each of FIGS. 1A and 1B shows a muffler pipe inside a muffler according to the first embodiment of the invention. FIG. 1A is a front view of the muffler pipe, and FIG. 1B is a cross-sectional view of the muffler pipe taken along the line A—A. Also, FIGS. 2A and 2B are enlarged views showing a valve disk in enlargement. FIG. 2A is a front view of the valve disk, and the FIG. 2B is a cross-sectional view of the valve disk taken along the line B—B.

A support member 10 having a tubular portion 11 is joined to an end portion of the muffler pipe 1, with a flange 12 as a valve seat formed in a tube end of the support member 10.

A mesh sheet 3 made of stainless material is bonded to a flange 12 that is the valve seat or a contact surface of the support member 10 and extends to an inner wall of the tubular portion 11.

A part of the flange 12 is extended downward in the figure and bent like a U-shaped character in an opposite direction of the muffler pipe 1 to form a support bracket 14.

The support bracket 14 supports a hinge axis 15 as a rotation axis, and a valve disk 20 is borne on the hinge axis 15 rotatably.

The valve disk 20 has a valve wall 21 opposed to the flange 12 of the support member 10, and a flange 22 around the peripheral edge of the valve wall 21.

One end 18 of the spring 16 wound around the hinge axis 15 engages a back face of the valve wall 21, the other end 19 being engaged by the support bracket 14.

As will be apparent from FIGS. 2A and 2B, the valve wall 21 has a ring-like outer peripheral portion 23 directly opposed to the flange 12 of the support member 10 and serving as a contact surface, the outer peripheral portion 23 being made a smooth plane. An inner diameter portion is a bead portion 24 projecting to the back side of the outer peripheral portion 23 or in a direction leaving away from or the flange 12 of the support member 10.

A flange 22 is formed around the outer peripheral edge of the outer peripheral portion 23 in the same projecting direction of the bead portion 24, and partially extended. A hinge portion 25 like a U-shaped character is composed of a bearing portion 27 rising from a base portion 26 and its both ends to align with the support bracket 14 like a U-shaped character. Reference numeral 32 denotes a notch to avoid the interference with an end 19 of the spring 16 engaging the support bracket 14.

The bearing portion 27 is provided with a pierced hole 28, into which is fitted a washer 29 formed of a stainless material mesh and having an inner diameter for allowing the hinge axis 15 to be passed.

On a back face of the valve wall 21, a weight 30 of rectangular block is fillet welded to the bead portion 24 on the inside of the peripheral flange 22 and fixed.

The weight 30 is attached with its center of gravity G offset from the center C of the valve wall 21 in the same direction as the hinge axis 15, as shown in FIG. 2A.

As shown in FIG. 1A, a coil portion 17 of the spring 16 on the hinge axis 15 is located on the sale side of the weight 30 in an axial direction, one end 18 of the spring being engaged in a region avoiding the weight 30 for bead portion 24 on a back face of the valve wall 21.

In the first embodiment as described above, the contact surface between the valve disk 20 and the valve seat (flange 12) is not inclined but planar, whereby there is less gap when the valve is closed even at a relatively low precision of the rotation axis of the valve disk 20, and owing to the weight 30 for the valve disk 20, the resonance frequency is reduced without changing the biasing force of the spring 16, whereby the beat sound is prevented from occurring in a normal range of the engine speed.

For example, in an ordinary exhaust system for the automobile, when the valve disk for a muffler pipe with a diameter of 50 mm is made of a steel plate with a thickness of 1.2 mm, the weight is selected in a range from 50 to 100 g.

While the outer peripheral portion 23 of the valve wall 21 that is the contact surface between the valve disk 20 and the valve seat is made planar, the bead portion 24 with its inside projecting to the back side from the outer peripheral portion 23 has the weight 30 welded thereto, whereby the effect of heat in welding is not conducted to the outer peripheral portion 23 to distort the contact surface.

Further, since the weight 30 is offset, a wide space is fixed on one side, one end 18 of the spring 16 can be easily engaged in the back face of the valve wall 21 by avoiding the weight 30. Conversely, since the weight 30 avoids an engagement point at one end 18 of the spring, there is no risk that one end of the spring is engaged accidentally in the weight 30 to change the urging force of the spring 16.

Since the mesh sheet 3 made of stainless material is bonded onto the flange 12 of the support member 10 as the valve seat, there occurs no impactive sound when the valve disk 20 is closed. And the mesh sheet 3 extends to an inner wall of the tubular portion 11 for the support member, thereby resulting in the secure bonded state.

In the first embodiment, the shape of the weight 30 is a rectangular block, but may be a circle, a semi-circle, and any other shapes.

The weight 30 may be fixed to the valve wall 21 by plug welding with a welding hole welded in the bead portion 24, and any other suitable means, without being limited to fillet welding.

Second Embodiment

The second embodiment of the present invention will be described below.

Figure 3A:
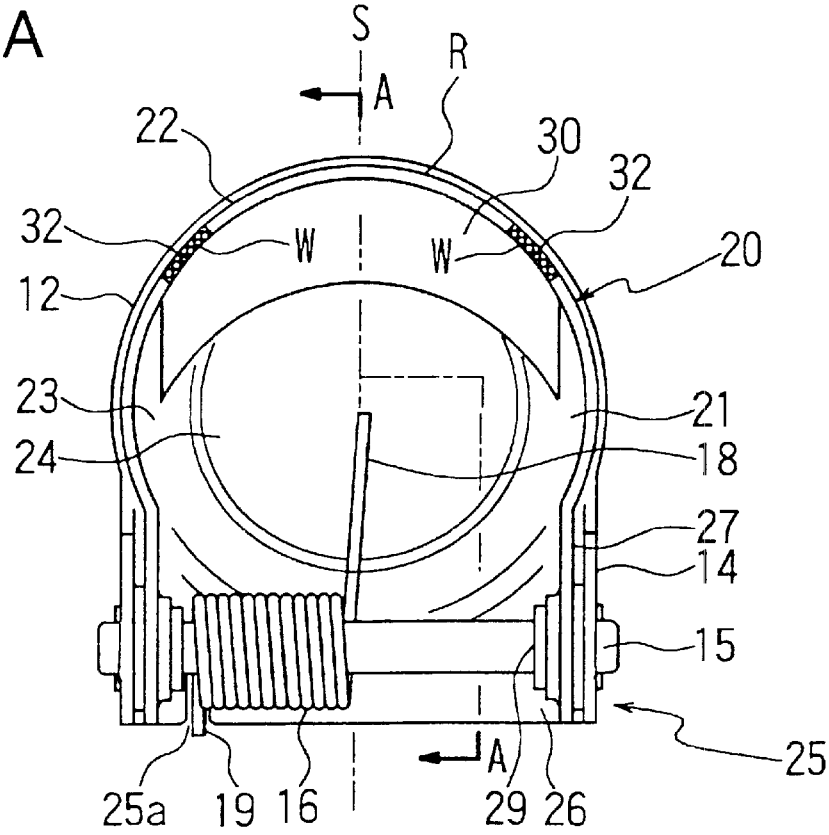
FIGS. 3A and 3B are views showing a second embodiment of the present invention.
Figure 3B:
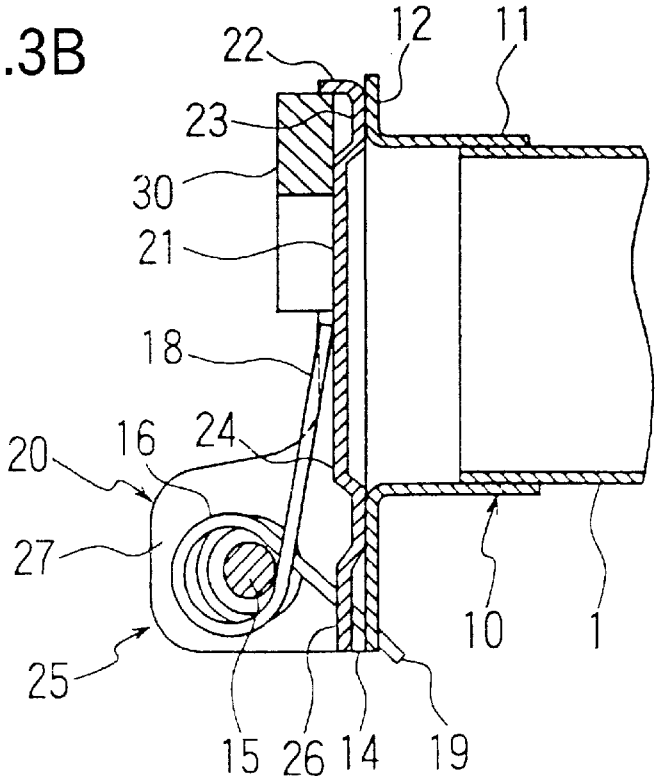
Figure 4:
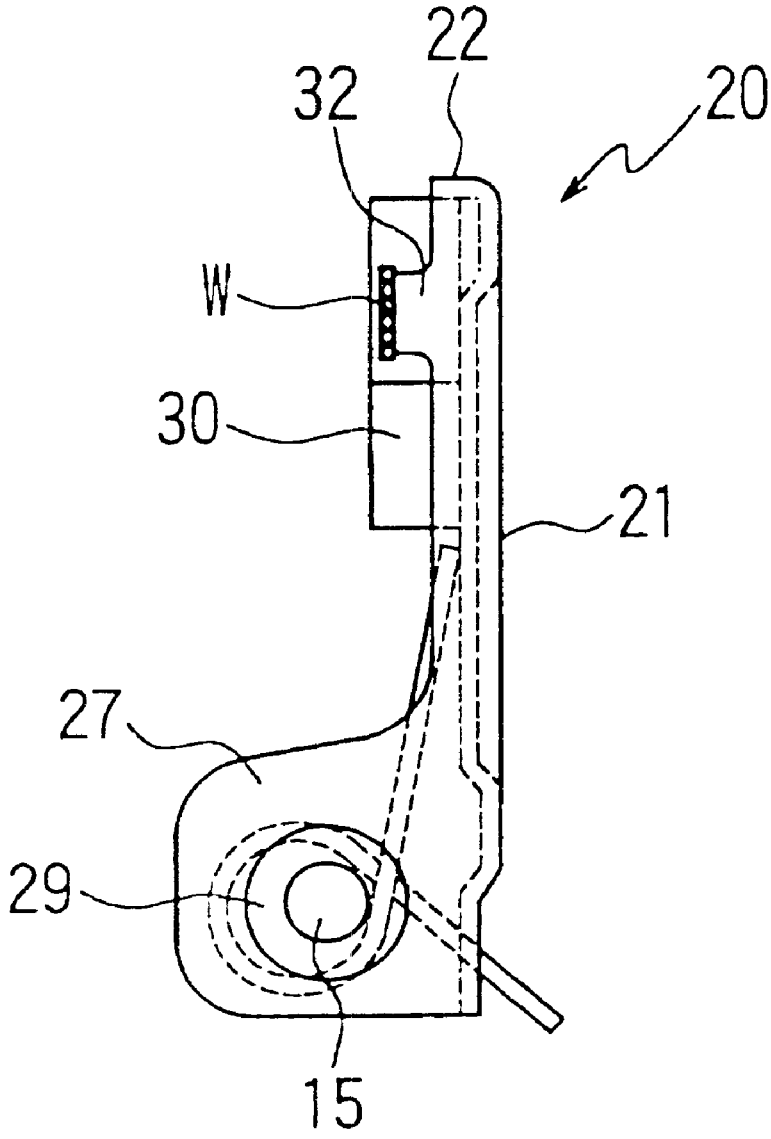
FIG. 4 is a side view of the second embodiment of the invention.

Each of FIGS. 3A and 3B shows a muffler pipe inside a muffler according to the second embodiment of the invention. FIG. 3A is a front view of the muffler pipe, and FIG. 3B is a cross-sectional view of the muffler pipe taken along the line A—A. Also, FIG. 4 is a side view of a valve disk.

A support member 10 having a tubular portion 11 is joined to an end portion of the muffler pipe 1, with a flange 12 as a valve seat formed in a tube end of the support member 10.

A part of the flange 12 is extended downward in the figure and bent like a U-shaped character in an opposite direction of the muffler pipe 1 to form a support bracket 14.

The support bracket 14 supports a hinge axis 15 as a rotation axis, and a valve disk 20 is borne on the hinge axis 15 rotatably.

The valve disk 20 has a valve wall 21 opposed to the flange 12 of the support member 10, and a flange 22 around the peripheral edge of the valve wall 21.

One end 18 of the spring 16 wound around the hinge axis 15 engages a back face of the valve wall 21, and the other end 19 engages the support bracket 14.

As will be apparent from FIG. 3B, the valve wall 21 of the valve disk has a ring-like outer peripheral portion 23 directly opposed to the flange 12 of the support member 10 and serving as a contact surface, the outer peripheral portion 23 being made a smooth plane. An inner diameter portion is a bead portion 24 projecting to the back side of the outer peripheral portion 23 or in a direction leaving away from or the flange 12 of the support member 10.

A flange 22 is formed around the outer peripheral edge of the outer peripheral portion 23, and partially extended. A hinge portion 25 like a U-shaped character is composed of a bearing portion 27 rising from a base portion 26 and its both ends to align with the support bracket 14 like a U-shaped character. Reference numeral 25*a* denotes a notch to avoid the interference with an end 19 of the spring 16 engaging the support bracket 14.

The bearing portion 27 is provided with a pierced hole 28, into which is fitted a washer 29 formed of a stainless material mesh and having an inner diameter for allowing the hinge axis 15 to be passed.

In an arcuate portion R away from the hinge axis 15 of the valve wall 21, the flange 22 has two projection pieces 32 projecting directly from the flange that are formed at two positions.

These projection pieces are arranged in bilateral symmetry with respect to the center line S passing through the center of the valve wall 21 and perpendicular to the hinge axis 15, as shown in FIG. 3A.

On a back face of the valve wall 21, the weights 30 of circular arc are disposed in bilateral symmetry of the center line S along the inside of the flange 22 in the arcuate portion R, and fillet welded (W) to the projection pieces 32 of the flange 22.

Figure 5:
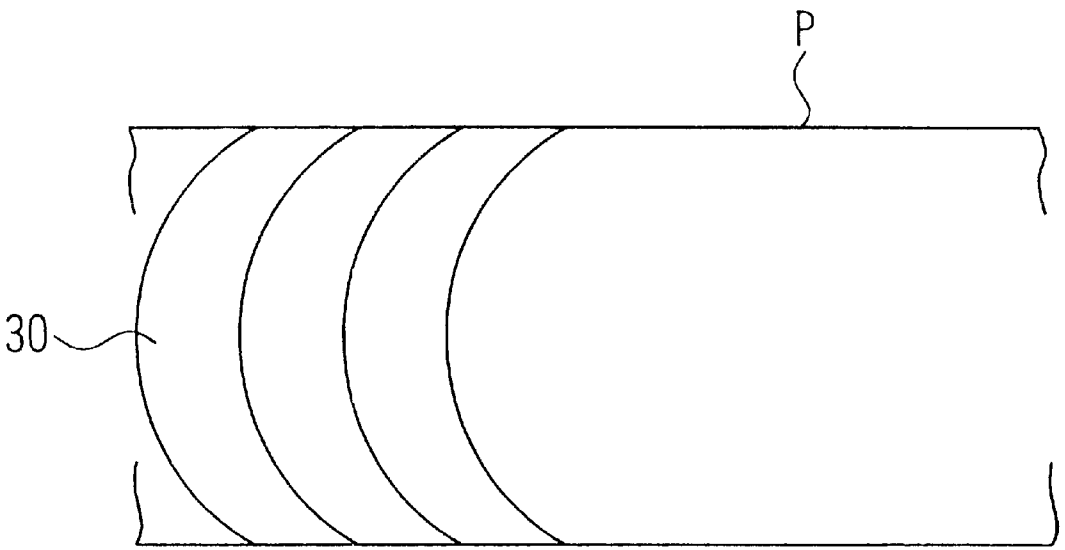
FIG. 5 is an explanatory view showing a way of fabricating a weight.

Each of the weights 30 is fabricated by cutting a strip steel plate P, in which its long sides are a circular arc to align with an inner wall of the flange 22 in the valve wall 21, and its short sides are parallel lines, as shown in FIG. 5.

In the second embodiment, the contact surface between the valve disk 20 and the valve seat (flange 12) is not an inclined face but a plain face, thereby developing less gap when the valve is closed even if the precision of the rotation axis for the valve disk 20 is relatively low. Because of the weights 30 for the valve disk 20, the resonance frequency is decreased without changing the biasing force of the spring 16, whereby the beat sound is prevented from occurring in a normal range of the engine speed.

Particularly, since the weights 30 are fixed along the arcuate portion R of the flange 22 around the outer peripheral edge of the valve disk, the maximum moment can be obtained for the hinge axis 15. Therefore, the resonance frequency can be effectively decreased by setting the weights 30 relatively lightly. For example, as compared with an instance where a weight of 90 g is fixed in the center of the valve wall 21, the weights 30 of 60 g or less can be employed to obtain the same moment.

The weights 30 can be produced in continuous basis with excellent yield without causing end material from the strip steel plate P. And when the weight is desired to change, as required, any weight can be produced only by changing the plate thickness of the strip steel plate P.

Since the weights 30 are welded to the projection pieces 32 projecting from the flange 22, the effect of heat in welding is suppressed not to distort the contact surface (outer peripheral portion 23) for the valve wall 21.

Further, the bead is formed on the valve wall, so that the rigidity is increased, and the smoothness of the contact surface with the valve seat can be kept.

Figure 6:
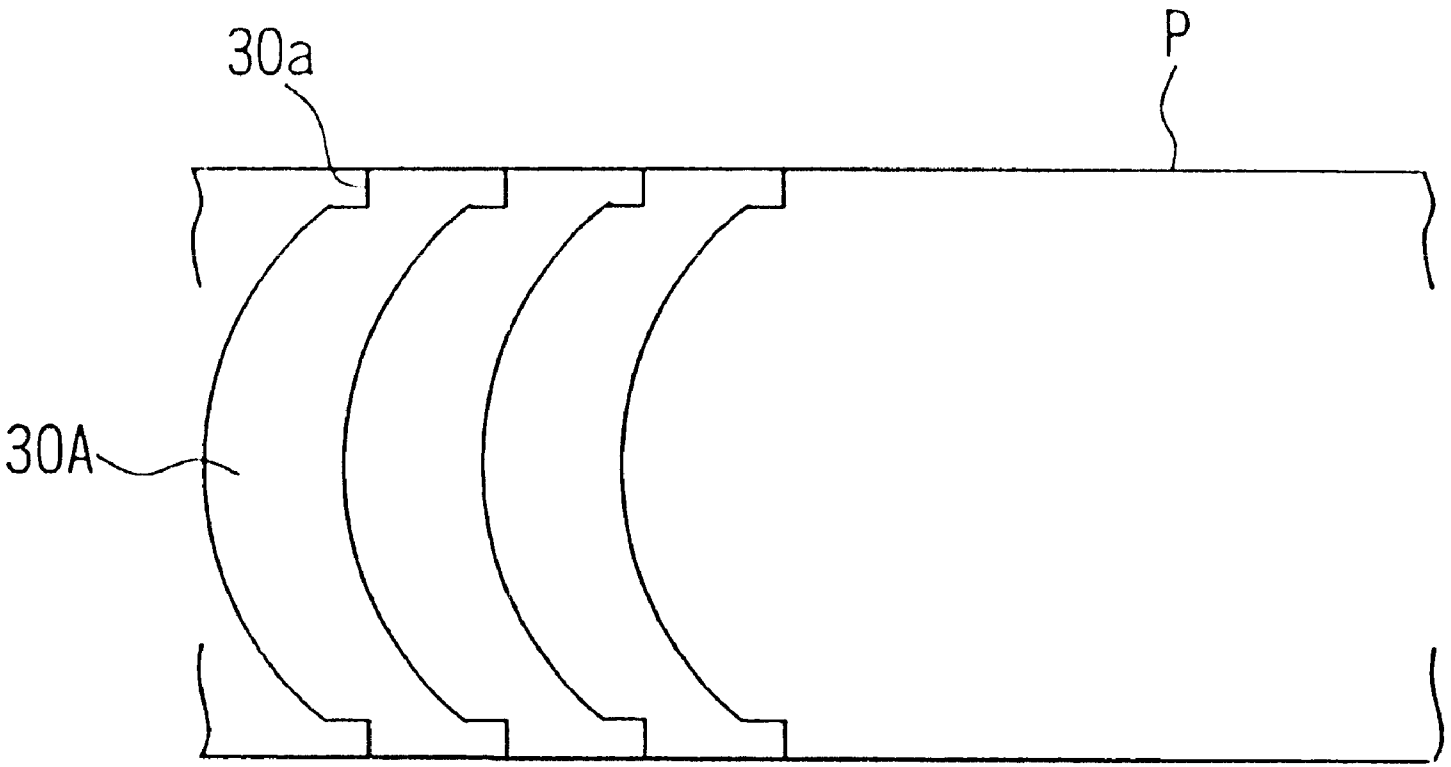
FIG. 6 is a view showing a variation of the weight.

In the second embodiment, the cut shape of the weights 30 is a simple circular arc. However, if a weight 30A is formed with the stages 30*a* at right angles to the line of short side along both edges of the long side, the acute angle at the end portion can be eliminated, whereby the weights are easy to handle in manufacture, as shown in FIG. 6.

Third Embodiment

A third embodiment of the invention will be described below. In the third embodiment, the weight is formed of a round bar steel.

Figure 7A:
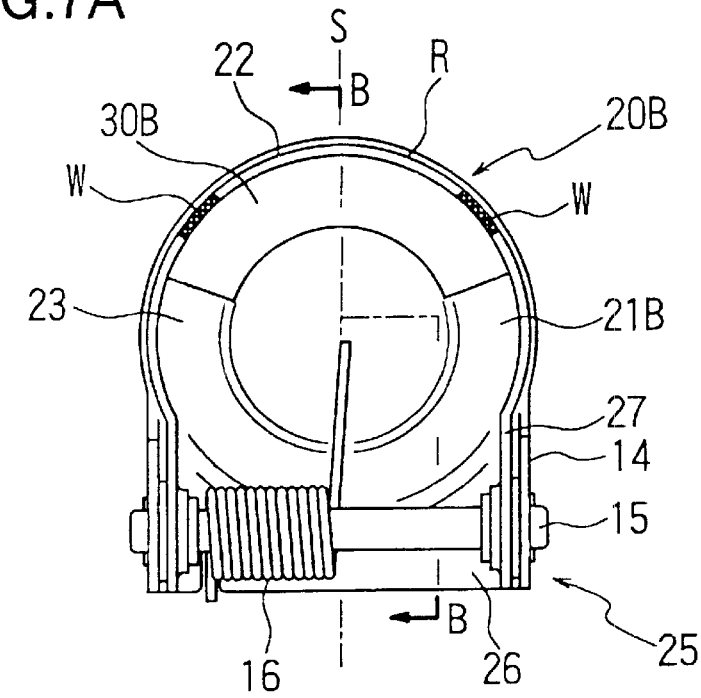
FIGS. 7A to 7C are views showing a third embodiment of the invention.
Figure 7B:
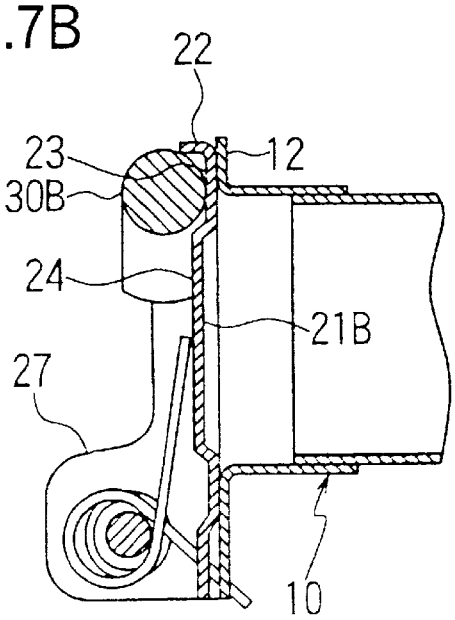
Figure 7C:
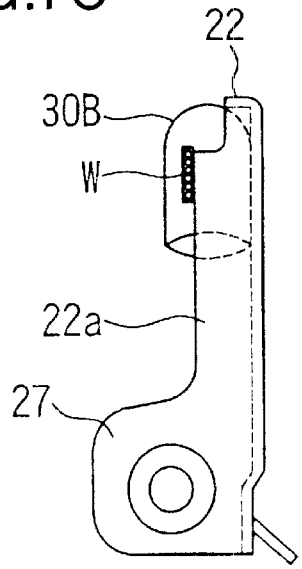

FIGS. 7A to 7C are views showing the third embodiment of the invention. FIG. 7A is a front view, FIG. 7B is a cross-sectional view taken along the line B—B, and FIG. 7C is a side view of a valve disk.

A flange 22 is formed around the outer peripheral edge of an outer peripheral portion 23, and partially extended, as in the second embodiment. A hinge portion 25 like a U-shaped character is composed of a bearing portion 27 rising from a base portion 26 and its both ends to align with the support bracket 14 like a U-shaped character.

The flange 22 has a narrower width in a certain range of an arcuate portion R along the outer peripheral portion 23 that is most left away from a hinge axis 15, but has a broader portion 22*a* toward the hinge axis 15 to link to a bearing portion 27.

On a back face of a valve wall 21B, the weights 30 bent arcuately and made of round bar steel are disposed along the inside of the flange 22 in the arcuate portion R, and fillet welded (W) to the broader portion 22*a* of the flange 22. The weights 30 are arranged in bilateral symmetry with respect to the center line S of the valve wall 21B, with the welded portions (W) also in bilateral symmetry, as shown in FIG. 7B.

Other constitution is the same as in the second embodiment, including the muffler pipe side.

In the third embodiment, since the weights 30B are fixed along the arcuate portion R of the flange 22 around the outer peripheral edge of the valve disk, the resonance frequency can be effectively decreased by setting the weights 30 relatively lightly, as in the second embodiment.

The weights 30B can be produced in continuous basis with excellent yield only by cutting and bending the round bar steel in required length, with reduced manufacturing costs. And when the weight is desired to change, as required, any weight can be produced only by changing the diameter or the cut length of the steel.

Since the welded portion of the weight 30B is a broader portion 22*a* of the flange, the effect of heat in welding is not conducted to a contact surface of the valve wall 21B to distort the contact surface.

Further, the bead is formed on the valve wall 21B, so that the rigidity is increased, and the smoothness of the contact surface with the valve seat can be kept.

Fourth Embodiment

A fourth embodiment of the invention will be described below. In the fourth embodiment, like the third embodiment, the weight is formed of a round bar steel.

Figure 8A:
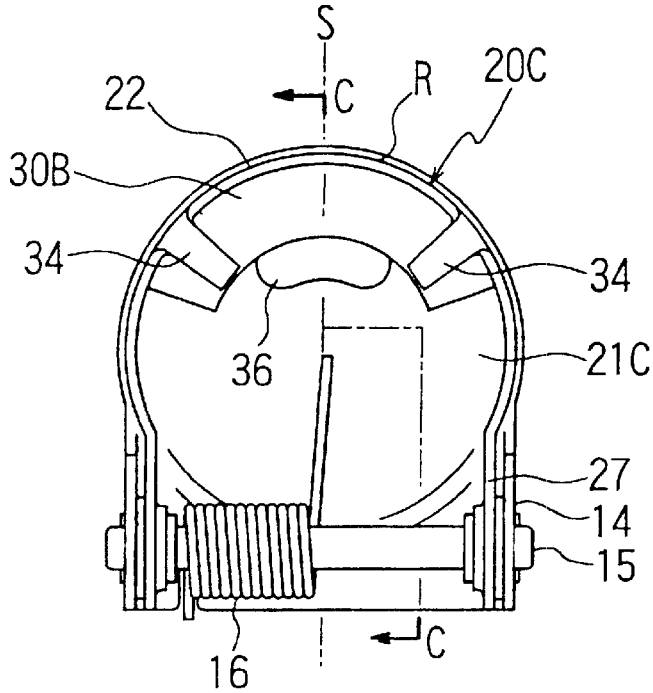
FIGS. 8A to 8C are views showing a fourth embodiment of the invention.
Figure 8B:
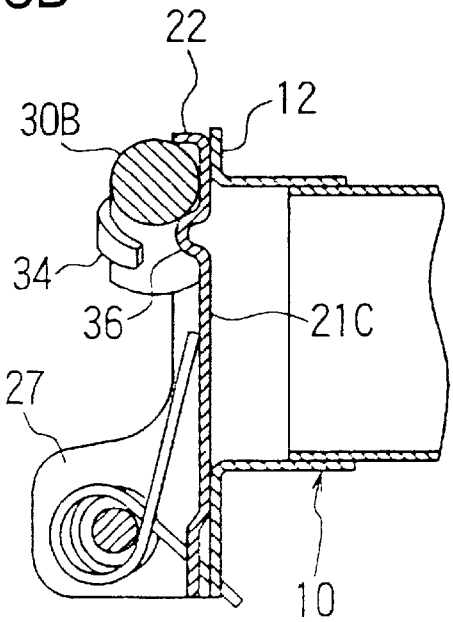
Figure 8C:
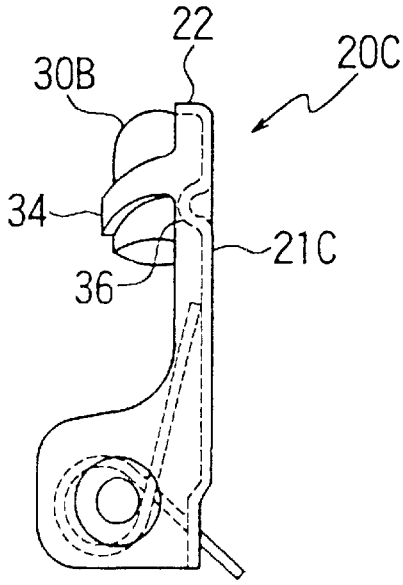

FIGS. 8A to 8C are views showing the fourth embodiment of the invention. FIG. 8A is a front view, FIG. 8B is a cross-sectional view taken along the line C—C in FIG. 8A, and FIG. 8C is a side view of a valve disk.

A valve wall 21C of the valve disk 20C has an entire smooth plane, with its outer peripheral area being a contact surface of a support member 10 with a flange 12.

A flange 22 is formed around the outer peripheral edge of the valve wall 21C, and the flange 22 leads to a bearing portion 27 in a certain width.

In an arcuate portion R away from a hinge axis 15 of the valve wall 21C, the flange 22 has two holding pieces 34 extending directly from the flange that are formed at two positions in bilateral symmetry with respect to the center line S, as shown in FIG. 8A.

On a back face of the valve wall 21C, a weight 30B bent arcuately and made of round bar steel is disposed along the inside of the flange 22 in the arcuate portion R, and the holding pieces 34 for the flange 22 extend over the weight 30B by caulking to press the weight 30B against the back face of the valve wall 21C.

Moreover, the valve wall 21C is formed with a convex portion 36 projecting to the back side between the holding pieces 34, 34 on the center line S to be contact with the inner face of the weight 30B of circular arc.

Thereby, the weight 30B is carried between the flange 22 and the convex portion 36 in a direction along a back face of the valve wall 21C, and carried between the back face and the holding pieces 34 in a direction perpendicular to the back face, so that the weight 30B is securely fixed to the valve wall 21C.

Other constitution is the same as in the third embodiment.

In the Fourth embodiment as described above, since the weight 30B of round bar steel bent is fixed along the arcuate portion R of the flange 22 around the outer peripheral edge of the valve disk, the resonance frequency can be effectively decreased by setting the weight 30 relatively lightly, as in the previous embodiment. Also, the weight can be easily changed.

Since the weight 30B is fixed by caulking between the convex portion 36 formed on the valve wall and the holding pieces 34, the welding is not required, and there is no effect of welding heat at all to distort the contact surface of the valve wall 21C.

Figure 9:
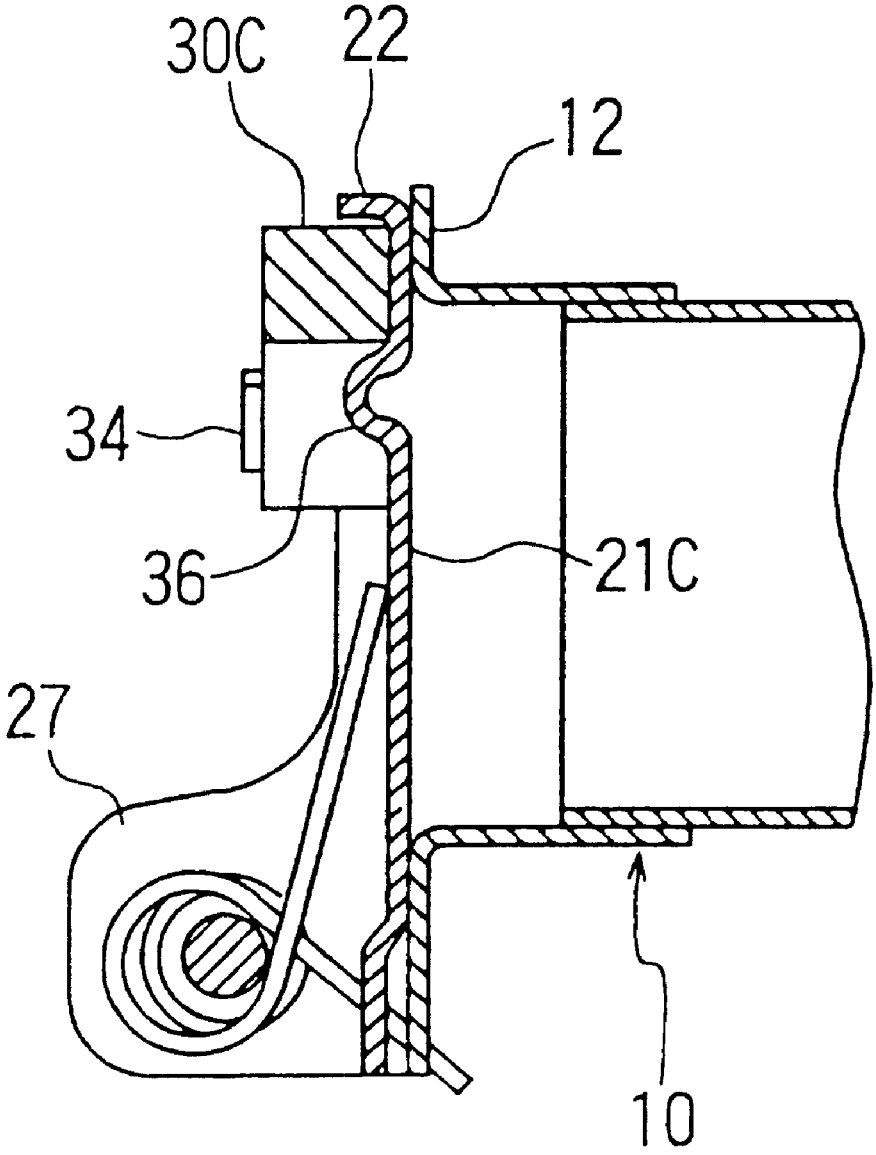
FIG. 9 is a view showing a variation.
Figure 10:
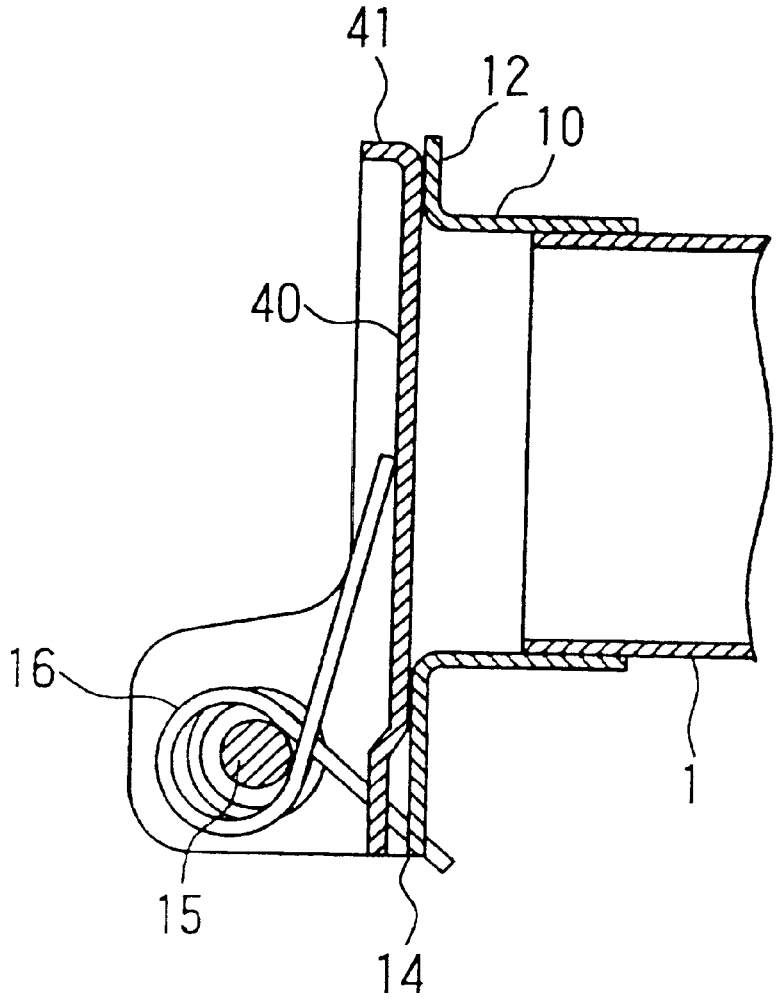
FIG. 10 is a view showing a conventional art example.

In the fourth embodiment, the weight 30B made of round bar steel is employed as in the previous embodiment. However, a weight 30C having a rectangular section may be used as shown in FIG. 9. Thereby, the weight 30C is carried between the flange 22 and the convex portion 36 in a direction along the back face of the valve wall 21C, and carried between the back face and the holding pieces 34 in a direction perpendicular to the back face, so that the weight 30C can be securely fixed to the valve wall 21 without welding. Of course, other steel having a polygonal section may be also employed so long as the cross section is the same.

In the fourth embodiment, the valve disk is directly contacted with the flange 12 of the support member 10 that is the valve seat. However, the mesh sheet made of stainless material may be bonded from the flange 12 to the inner wall of the tubular portion 11 to suppress the impactive sound caused when the valve disk is closed.

As described above, the invention provides a valve structure for an engine exhaust system in which a valve is opened or closed in accordance with an exhaust pressure, with a valve disk being biased by a spring, wherein the valve disk is formed with a bead portion in a region excluding a contact surface of a valve wall with a valve seat, and a weight is fixed to the bead portion. Thereby, the resonance frequency of the valve disk can be changed while the predetermined characteristics of the spring are retained. Hence, it is possible to prevent the beat sound from arising due to vibration of valve disk in a normal range of the engine speed, and the quality sense of the vehicle can be improved.

Particularly, the valve wall has the outer peripheral portion shaped like a ring as the contact surface, the bead portion has an inner diameter portion projecting to the back side from the outer peripheral portion, and the weight is fixed to the bead portion on the back face of the valve wall. Thereby, there is no risk that the weight interferes with the valve seat.

The spring is wound around the rotation axis, with one end engaging the back face of the valve wall, and the weight is fixed except for an engagement point at one end of the spring. Thereby, there is no risk that one end of the spring is engaged on the weight accidentally to change the biasing force of the spring.

According to the present invention, a valve is opened or closed in accordance with an exhaust pressure, with a valve disk biased in a closing direction by a spring being supported around a rotation axis, wherein the valve disk has a weight of circular arc fixed on a back face along an outer peripheral edge including an arcuate portion most left away from the rotation axis of a valve wall. Thereby, the resonance frequency of the valve disk can be changed while the spring is kept at the predetermined characteristics. The vibration of the valve disk in a normal range of the engine speed is prevented from causing the beat sound, whereby the quality sense of the vehicle can be improved.

And since the weight is fixed along the arcuate portion around the outer periphery edge of the valve disk, the maximum moment can be obtained for the rotation axis. Thereby, the resonance frequency can be controlled while the lighter weight is set.

Since the flange is formed around the outer periphery of the valve wall, the weight can be positioned by abutting it against the inside of the flange, and securely welded to the flange.

In this case, the flange is further provided with a projection piece, and the weight is welded at the tip of the projection piece. Thereby, the welded part is separated away from the contact surface with the valve seat, and the effect of welding heat on the contact surface is suppressed.

Also, the flange comprises a holding piece is formed around the outer periphery of the valve wall, and a convex portion projecting to the back side is formed inside a contact surface of the valve wall with the valve seat, whereby the weight is disposed between the flange and the convex portion along the inside of the flange, and pressed and fixed to the valve wall by caulking of the holding piece. Thereby, no welding is used, and the effect of welding heat is not caused.

The weight is formed by cutting a strip steel plate, or bending a steel material of a predetermined cross section. Thereby, the weight can be produced with excellent yield.

What is claimed is:

1. A valve structure for an engine exhaust system, comprising:

a valve disk attached to an exhaust pipe, the valve disk being opened or closed in accordance with an exhaust pressure in the exhaust pipe, the valve disk comprises:

a valve wall having a contact surface to abut with a valve seat of the exhaust pipe; and a convex portion;

a spring for biasing the valve disk to close the exhaust pipe;

a rotation shaft for rotatably supporting the valve disk; and a weight fixed to the convex portion.

2. The valve structure according to claim 1, wherein the valve wall of the valve disk is defined around the convex portion.

3. The valve structure according to claim 2, wherein the convex portion projects from a back surface of the valve disk opposed to the contact surface of the valve wall; and the weight is fixed to the convex portion on the back surface of the valve wall.

4. The valve structure according to claim 1, wherein the spring is wound around the rotation shaft;

one end of the spring engages the back surface of the valve wall; and the weight is fixed on the back surface of the valve wall except for an engagement point with the one end of the spring.

5. A valve structure for an engine exhaust system, comprising:

a valve disk attached to an exhaust pipe, the valve disk being opened or closed in accordance with an exhaust pressure in the exhaust pipe, the valve disk comprising a valve wall defined on an outer peripheral edge of the valve disk, the valve disk having a contact surface to abut with a valve seat of the exhaust pipe; and a spring for biasing the valve disk to close the exhaust pipe;

a rotation shaft for rotatably supporting the valve disk; and a weight formed of a circular arc and fixed on a back surface of the valve disk, the weight disposed along an arcuate portion of the valve wall most left away from the rotation shaft.

6. The valve structure according to claim 5, wherein the valve disk comprises a flange formed around the outer periphery of the valve wall; and the weight is disposed along the inside of the flange and welded to the flange.

7. The valve structure according to claim 6, wherein the flange includes a projection piece, and the weight is welded at the tip of the projection piece.

8. The valve structure according to claim 5, wherein the valve disc comprises:

a flange having a holding piece, the flange formed around the outer periphery of the valve wall;

a convex portion projects from a back surface of the valve disk opposed to the contact surface of the valve wall; and the weight is disposed between the flange and the convex portion along inside of the flange; and the holding piece of the flange presses the weight to be caulked and fixed to the valve wall.

9. The valve structure for the engine exhaust system according to claim 5, wherein the weight is formed by cutting the strip steel plate.

10. The valve structure according to claim 5, wherein the weight is formed by bending a steel material having a predetermined cross section.

* * * * *